US005725210A

United States Patent [19]

Yamaguchi et al.

[11] Patent Number: 5,725,210

[45] Date of Patent: Mar. 10, 1998

[54] GAME MACHINE

[75] Inventors: Toshiharu Yamaguchi, Gifu; Norihiko Seo, Kanagawa; Shunpei Yamazaki, Tokyo, all of Japan

[73] Assignee: Semiconductor Energy Laboratory Co., Ltd., Kanagawa, Japan

[21] Appl. No.: 660,714

[22] Filed: Jun. 10, 1996

Related U.S. Application Data

[63] Continuation of Ser. No. 361,098, Dec. 21, 1994, abandoned.

[30] Foreign Application Priority Data

Dec. 27, 1993 [JP] Japan ..... 5-354093

[51] Int. Cl.[6] ..... A63F 7/02

[52] U.S. Cl. ..... 273/121 B

[58] Field of Search ..... 273/118, 119, 273/121

[56] References Cited

U.S. PATENT DOCUMENTS 4,323,241 4/1982 Deutsch ..... 273/121 A 4,375,286 3/1983 Seitz et al. ..... 273/121 A 4,406,457 9/1983 Gabrius et al. ..... 273/121 A 4,508,336 4/1985 Yokoi ..... 273/121 B X 5,131,655 7/1992 Ugawa ..... 273/118 A X 5,316,303 5/1994 Trudeau et al. ..... 273/118 A X

FOREIGN PATENT DOCUMENTS

92/04954 4/1992 WIPO ..... 273/121 B

*Primary Examiner*—Raleigh W. Chiu

*Attorney, Agent, or Firm*—Sixbey, Friedman, Leedom & Ferguson, P.C.; Gerald J. Ferguson, Jr.

[57] ABSTRACT

A game machine is provided in which the effective area for the game is not restricted even if the display area of the variable display unit is increased. The game machine comprises a variable display unit having an electronic display device, and a transparent area arranged with nails, decorations such as pinwheels, and a winning port which area is provided in front of the variable display unit.

15 Claims, 2 Drawing Sheets

GAME MACHINE

This application is a Continuation of Ser. No. 08/361,098, filed Dec. 21, 1994, now abandoned.

BACKGROUND OF THE INVENTION

1. Field of the invention

The present invention relates to a game machine of a type in which balls move around on the game board. More particularly, it relates to a pachinko machine which has an electronic display device in a variable display unit for indicating game information and for presenting game effects.

2. Description of the Prior Art

Game machines such as pachinko machines and pinball machines of a type in which balls move around on a nail-studded game board having decorations such as pinwheels provided on the game board, and winning ports are a widespread entertainment phenomenon which has enjoyed a stable popularity.

Recent pachinko machines have, in particular, come to use a matrix color liquid crystal display in their variable display units for presenting a varying set of pictures and images of slot machines to provide a greater variety of entertainment for players and to help maintain their popularity.

Generally, when a variable display unit is provided on a game machine such as a pachinko machine or pinball machine of a type in which balls move around on the game board, no object or item is installed on the front of the variable display unit to ensure that no obstacle blocks the viewing of the details of the presentation.

However, because the size of the display area has been increased in the variable display unit for increasing the amount of information displayed to enhance the game's effects and/or information, the variable display unit thus occupies more area on the game board and the effective game area (the region where pachinko balls can freely move) is reduced so that the game attraction of the pachinko machine becomes restricted.

In addition, the replacement of a pachinko machine is typically conducted by completely replacing the machine itself. Replacing and disposing (scrapping) of a pachinko machine which is still mechanically and electrically usable, only because it is obsolete in terms of the content of its game or because it fails to attract popularity do not match the requirements of an era which are promoting the recycling of industrial products. Furthermore, disposing (scrapping) of pachinko machines has already become the cause of a social issue as to its site and method of disposal since the pachinko machines have been disposed (scrapped) in large numbers in recent years.

Also, as described earlier, recent versions of pachinko machines have started using color liquid crystal displays in the variable display unit. This tend is expected to continue, and its size is tending to grow increasingly larger in scale to increase the cost of the variable display unit per game machine more and more.

It is therefore becoming disadvantageous in view of the expense if one game machine is junked each time a new version comes out.

SUMMARY OF THE INVENTION

It is an object of the present invention to provide a game machine, particularly a pachinko machine, having a configuration whose effective area for game is not limited even if the size of the display in the variable display unit is increased.

It is another object of the present invention to provide a game machine whose replacement is reduced to save on cost.

To attain the above objects, the present invention is a game machine comprising a variable display unit having an electronic display device, and an area in front of the variable display unit arranged with nails, decorations such as pinwheels, and a winning port.

In addition, the present invention is a game machine comprising a variable display unit having an electronic display device, and an area in front of the variable display unit which is transparent and arranged with nails, decorations such as pinwheels, and a winning port.

With such an arrangement, the game board is removable (or detachable) from the game machine.

With such an arrangement, the game board has a base board consisting of a transparent planar material.

Further, the present invention is a game machine comprising a game board having at least one transparent area over which balls pass, and an electronic display device below the transparent area.

Furthermore, the present invention is a game machine comprising a game board having at least one transparent area over which balls pass, an electronic display device below the transparent area, and a means for sensing the ball passing over the transparent area.

Still further, the present invention is a game machine comprising a game board having at least one transparent area over which balls pass, an electronic display device below the transparent area, and a means for sensing the position of the ball passing over the transparent area.

That is, the game machine according to the present invention is provided with a variable display unit having an electronic display device on the back of a game board, and nails, decorations such as pinwheels, and a winning port are provided in front of the variable display unit, or provided with an area which is transparent and over which balls pass, nails, decorations such as pinwheels, and a winning port on the game board in front of the variable display unit.

In addition, a means is provided for detecting presence and/or position of balls which pass over the top surface of the transparent area.

In the specification, the game board means a panel material on which there are nails, decorations such as pinwheels, and a winning port, while the panel material itself is called a base board or a substrate.

Although the present invention mainly uses a liquid crystal display as the electronic display device, it is not limited to such liquid crystal display, but may be any other display such as a plasma display, an LED display, or a cathode ray tube display. It may also be a projector, and is not limited to a particular size.

The game board may be partially transparent, or may be wholly transparent by constituting the base board itself of a transparent material. It is sufficient that all or parts of the variable display unit below (behind) the base board can be viewed from above (before) the board (the surface over which the ball passes).

In addition, it may be acceptable to constitute the variable display unit of a size substantially the same as that of the game board so that the entire surface of the game board becomes the variable display unit, rather than to provide it on a part of the game board. It is also acceptable to provide a plurality of variable display units.

Although it is desirable to use a transparent board at the transparent area, only a hole may be opened in the base board if the ball can pass over the top surface without trouble.

The board material used for the transparent area on the game board is a material with transparency and good workability such as a transparent plastic panel (a transparent plastic plate), an acrylic panel, or a laminated combination of them if nails or the like are to be included. Of course, a glass panel may be used if it is suitable. Alternatively, it may be a laminated structure of a glass panel and a transparent plastic panel, acrylic panel, or PVC film (vinyl film). It may be also possible to form an abrasion-resistant thin film such a diamond thin film on the surface.

A switch function may be provided for the decorations themselves on the transparent area as a means for detecting the presence or position of the ball passing over the transparent area. Furthermore, it may be possible to use either optical or contact sensors such as an infrared sensor around the transparent area or a transparent touch sensor on the top surface of the transparent area. It may be possible to provide a detector means on the electronic display device itself. The detection may be performed over the entire top surface of the transparent area in a matrix fashion, or only in a particular region.

If electrical wiring must be provided on the transparent area, particularly when the entire base board is constituted of a transparent material, it is sufficient to form a transparent conductive film such as indium tin oxide (ITO) on the top or bottom surface of the transparent material.

According to the present invention, the front surface of the variable display unit of a game machine such as a pachinko machine can be used as the game region. Therefore, the effective game area remains the same size even if the display area of the variable display unit is increased so that the game-playing capability is not lost.

Rather, because the larger display area can be used for displaying animation and the like, and various changes can be made to the display, it is possible to enhance the impact on the player, and therefore, to improve the degree of entertainment as a game.

Furthermore, it becomes possible to change the display on the variable display unit according to the movement or speed of the ball, and to change details of the game such as the number of won balls by detecting the presence or position of the ball passing over the transparent area.

In addition, in updating the game machines, particularly if the entire base board is made transparent, and almost all of the game board surface constitutes the image of the variable display unit, the updating can be attained simply by changing the display program for the electronic display on the variable display unit, or simply by changing the display program and replacing the game board if the game board is arranged so that it can be removed, thus significantly reducing the amount of waste.

DESCRIPTION OF THE PREFERRED EMBODIMENT

Figure 1:
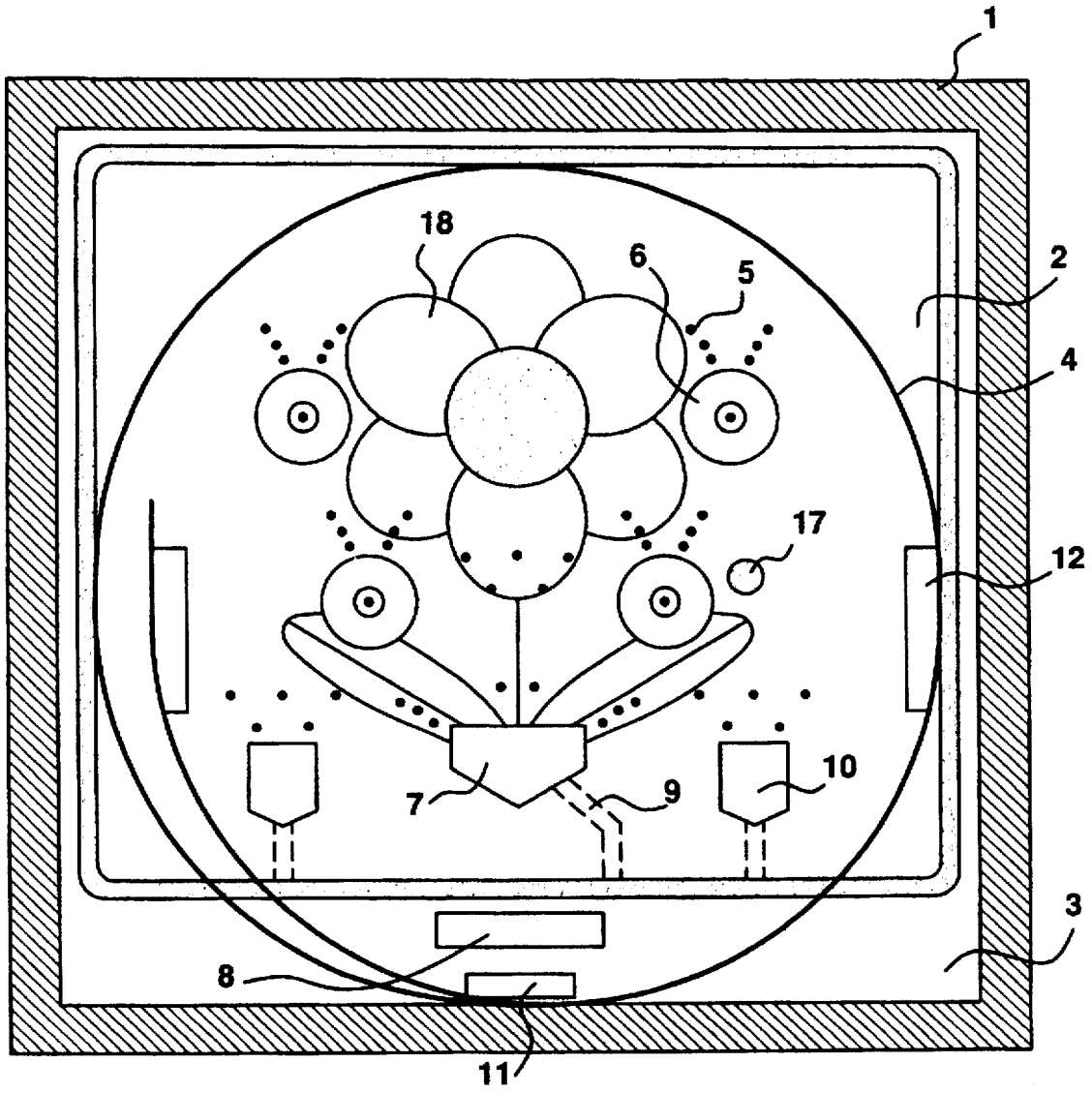
FIG. 1 is a front view of the pachinko machine of the embodiment.

An embodiment of the present invention will be explained by referring to the drawings in detail below. FIG. 1 shows an embodiment of a pachinko machine for which an electronic display device and a game board according to the present invention are used, in a front view thereof.

In FIG. 1, a reference numeral 1 denotes the frame of the game machine, and a reference numeral 2 denotes a variable display unit of a liquid crystal display disposed on the back of the game board 3 of the pachinko machine. Here, the area of the liquid crystal display screen occupies most of the area of the game board 3, and a picture 18 is generated by a display on the liquid crystal display.

The removable game board 3 is installed in front of the liquid crystal display. The base board is constituted of a sufficiently transparent board material which is an acrylic panel here to avoid disturbing the liquid crystal display when viewing it from the front.

Figure 2:
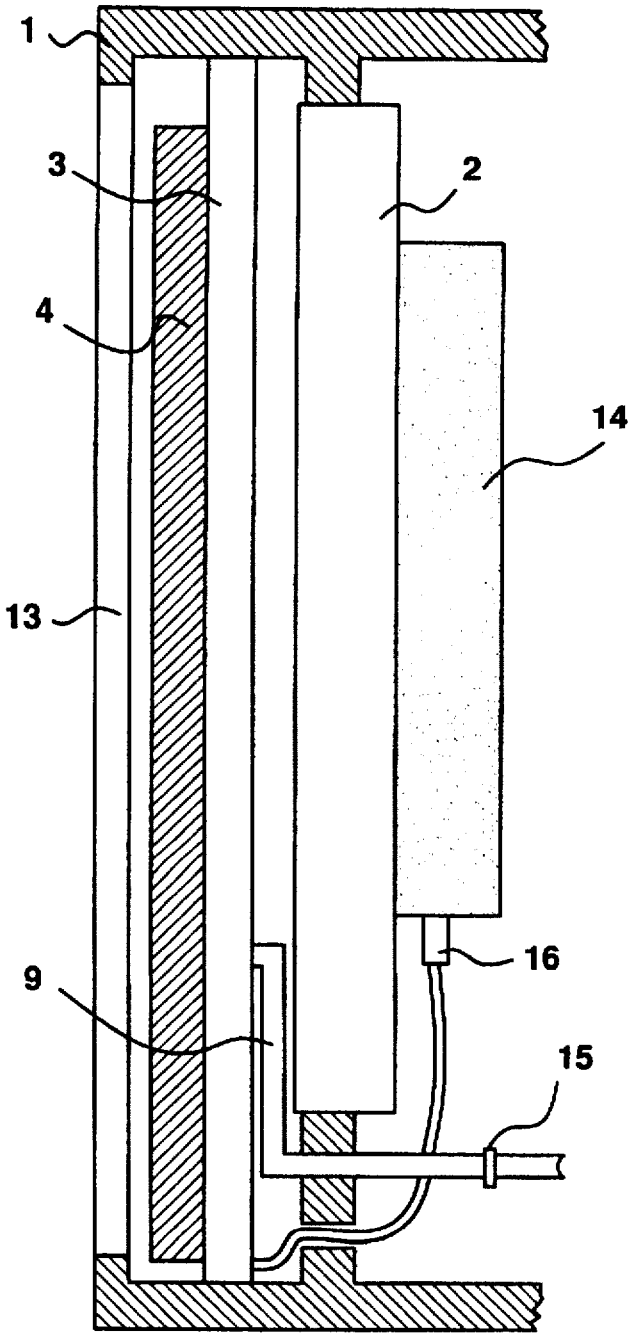
FIG. 2 is a side view of the pachinko machine in FIG. 1.

FIG. 2 shows a cross-sectional side view of the game machine in FIG. 1, wherein a reference numeral 13 denotes a front glass panel, a reference numeral 14 denotes an electronic control board housing, and a reference numeral 15 denotes a start-up winning ball detector.

A guide rail 4, nails 5, a rotary pinwheel 6, a start-up winning port 7, a jackpot port 8, and other winning ports 10 are arranged on the front side of the game board 3, while a winning ball guide 9 is arranged on the back. It is effective to constitute them with a transparent material so as to provide them with transparency.

The transparent board 3 is installed on the game board 1 in an easily removable fashion such as with screws or by insertion so that it can be easily replaced.

Although not shown, the game board 3 is arranged with electrical wiring for turning indicators 12 on or off, a drive unit for opening and closing the jackpot port 8, and its electrical wiring, which are connected to an electronic control board in the electronic control board housing 14 through a connector 16. The wiring is led to the surrounding nontransparent region by a transparent electrode consisting of ITO.

Referring to FIG. 1, a pachinko ball 17 projected by a ball projector (not shown) travels along the guide rail 4, bumps against or is guided by the nails 5 and the pinwheels 6 while dropping, and, if it enters in the winning port 7, becomes a winning ball. The winning ball is guided to the winning ball guide 9, and detected by the start-up winning ball detector 15 (FIG. 2). The detection is converted to an electric signal, which is then input to the electronic control board (not shown) in the electronic control board housing 14 (FIG. 2) as an input signal.

Upon receipt of the signal, a CPU on the electronic control board determines various decisions to control the display screen of the liquid crystal display which constitutes the variable display unit 2, opening or closing operations of the jackpot port 8 on the game board 3, and turning the indicator 12 on or off.

Here, if no ball enters in the start-up winning port 7 for three minutes, the displayed flower 18 starts fading.

In addition, a missed ball is returned through a reject port 11.

Infrared sensors (not shown) are installed around the game board so that the position of the pachinko ball can be detected with a 10×10 matrix within the traveling range of the ball. Here, it is arranged so that, when a pachinko ball enters in the start-up winning port 7, a character (not shown) displayed on the variable display unit chases the ball dropping on the game board surface.

It can be used to detect whether or not a ball enters in the winning port with the sensor. In such a case, it may have a structure that the ball pass through the winning port as is without providing the winning ball guide 9. With such an arrangement, it becomes possible to avoid a situation such that the display on the variable display unit is hidden by the winning ball guide. It may be also possible to provide a function for detecting the ball on the winning port itself.

According to the present invention, the front surface of the variable display unit of the game machine can be utilized as the ball moving region so that there is no limitation on the size of variable display unit and an electronic display device with a large screen can be used for the front surface of the variable display unit of the game machine. As a result, the amount of displayed information is significantly increased so that it becomes possible to provide more variety with the contents of the display and to increase the degree of freedom. Thus, in turn, it becomes possible to provide new possibilities and fascination with the pachinko machine or pinball machine.

Furthermore, it becomes possible to vary the display on the variable display unit and the details of the game such as the number of prize balls according to the movement or speed of a ball passing over the transparent area by detecting the presence of the balls passing over the transparent area.

In addition, the updating of pachinko machines can be performed simply by changing the display data for the electronic display device with a large screen on the variable display unit, which can be performed by replacing the electronic control board, and/or by replacing the transparent game board. Therefore, the waste produced in the updating of the game machines is only the electronic control board and/or the transparent game board so that waste can be significantly reduced. Furthermore, the ease of replacement also reduces the time and cost required for replacement.

What is claimed is:

1. A game machine comprising:

a variable display having an electronic display device; and a substrate arranged with a nail, a decoration, and a winning port which are provided in front of the variable display.

2. The machine of claim 1 wherein said decoration comprises a pinwheel.

3. The machine of claim 2 wherein said nail and said pinwheel comprise a transparent material.

4. The machine of claim 1 wherein said substrate comprises a transparent plate.

5. The machine of claim 1 wherein said substrate is detachable from said game machine.

6. The machine of claim 1 wherein said electronic display device is a liquid crystal display, a plasma display, a LED display or a cathode ray tube display.

7. A game machine comprising:

a variable display having an electronic display device; and a game board including a transparent area arranged with a nail, a decoration, and a winning port which are provided in front of the variable display.

8. The machine of claim 7 wherein said decoration comprises a pinwheel.

9. The machine of claim 7 wherein said game board is detachable from said game machine.

10. The machine of claim 7 wherein said electronic display device is a liquid crystal display, a plasma display, a LED display or a cathode ray tube display.

11. The machine of claim 7 wherein said game board comprises a transparent plate substrate.

12. A game machine comprising:

a variable display having an electric display device; and a substrate arranged with means for changing movement of a ball passing over the substrate, said means being provided in front of the variable display.

13. The machine of claim 12, wherein said means comprises at least one of a guide rail, a nail, a rotary pinwheel, a start-up winning port and a jackpot port.

14. A game machine comprising:

a variable display having an electric display device; and a game board including a transparent area arranged with means for changing movement of a ball passing over the game board, said means being provided in front of the variable display.

15. The machine of claim 14, wherein said means comprises at least one of a guide rail, a nail, a rotary pinwheel, a start-up winning port and a jackpot port.

* * * * *